United States Patent [19]

Yamashita

[11] 4,224,811

[45] Sep. 30, 1980

[54] AUTOMATIC WASHER

[75] Inventor: Kiyoshi Yamashita, Suzuka, Japan

[73] Assignee: Tokyo Shibaura Denki Kabushiki Kaisha, Kawasaki, Japan

[21] Appl. No.: 25,677

[22] Filed: Mar. 30, 1979

[30] Foreign Application Priority Data

Apr. 14, 1978 [JP] Japan ..... 53-43843

[51] Int. Cl.[3] ..... D06F 17/06; D06F 39/08

[52] U.S. Cl. ..... 68/12 R; 68/23.6; 68/207; 68/208

[58] Field of Search ..... 68/12 R, 207, 208, 23.4, 68/23.6

[56] References Cited

U.S. PATENT DOCUMENTS 2,972,877 2/1961 Platt ..... 68/208 X

FOREIGN PATENT DOCUMENTS 50-605075 9/1960 Canada ..... 68/207
50-114176 9/1975 Japan ..... 68/207
52-6552 2/1977 Japan .

*Primary Examiner*—Philip R. Coe
*Attorney, Agent, or Firm*—Cushman, Darby & Cushman

[57] ABSTRACT

An automatic washer which comprises a washer body used to receive water and provided with a water-draining passage; a rotary tub built in the washer body to hold water and material of washing and fitted with a stirring blade member; drive means for selectively rotating the stirring blade member or rotary tub; water guide passage extended between the water-draining passage and the bottom of the rotary tub and fitted with a valve in an intermediate position; and a timer which, during washing and rinsing steps, closes the valve to supply water to the rotary tub, rotates the stirring blade member to produce vertical streams of water for washing, and, during water drain and dehydration steps, opens the valve to expel water from the water guide passage, rotates the rotary tub, and discharges water into the washer body from above the rotary tub by a pumping action resulting from the rotation of the rotary tub, wherein that side of the valve of the water guide passage which faces the water-draining passage is designed to cause water to flow at in higher rate than on that side of said valve which faces the rotary tub; an air trap is provided on that side of the water guide passage valve which faces the rotary tub; and the timer is designed to open the valve during the water drain and dehydration steps, and rotate the rotary tub when a fall in the water level in the rotary tub is detected by a decrease in air pressure in the air trap.

4 Claims, 13 Drawing Figures

AUTOMATIC WASHER

This invention relates to an automatic washer in which material of washing and water are held in a tub, and washing and dehydration are carried out therein.

With the prior art automatic washer, a rotary tub used concurrently for washing and dehydration is provided with a large number of dehydration ports in the peripheral wall. Disposed outside of the rotary tub is a water receptacle, of which a water level gauge is set and to the bottom of which there is connected a water-draining passage provided with an electromagnetic valve in an intermediate position. During washing, the valve is closed and water is supplied to the rotary tub and water receptacle. When the water supplied reaches a prescribed level, the level gauge causes a stirring blade member mounted on the inner bottom wall of the rotary tub to be rotated in order to generate vertical streams of water for washing. During water drain and dehydration, the valve is left open. Water in the rotary tub and water receptacle is drawn off through the water-draining passage. After the water level gauge determines whether water still remains in the rotary tub, the rotary tub is rotated. As a result, water soaked in the material of washing is centrifugally expelled through dehydration ports into the water receptacle and finally drawn out of the washer through the water-draining passage.

Where an operator forgets to throw downward a water-draining hose with a resultant decline in the water-draining function of the washer, then water draining is temporarily stopped by means of the water level gauge. Thereafter, the supply of clear rinsing water is stopped to prevent water from overflowing the water receptacle.

However, the known automatic washer of the above-mentioned type has the drawbacks that during washing, water is supplied to not only the rotary tub, but also the water receptacle lying outside thereof; water lying in the water receptacle is simply wasted from the standpoint of washing; since a detergent escapes into said water region, it is necessary to apply a larger amount of a detergent than otherwise in order to effect proper washing; and since material of washing is dehydrated after water is drained out of the washer, completion of said dehydration takes an unnecessarily longer time than otherwise.

In view of the above-mentioned drawbacks, another automatic washer has been proposed wherein a rotary tub free from dehydration ports is set in the washer body; the bottom wall of the rotary tub is connected to the water-draining passage by a water guide provided with a valve in an intermediate position; and a water level gauge is mounted on the rotary tub. With this proposed washer, water is received only in the rotary tub during washing. During water drain and dehydration, only some portion of the water left in the rotary tub is drawn off from the bottom thereof through the water guide and water-draining passage. At this time, the rotary tub is rotated, and the most of the water is discharged into the washer body from above the rotary tub by a pumping action resulting from the centrifugal force of the rotating tub, and drawn out of the washer through the water-draining passage. With the proposed washer, the water level gauge can indeed determine whether a sufficient amount of water is supplied during washing, but during water drain, presents difficulties in detecting a fall in the water level in the rotary tub when water is drained through the water guide, and controlling the subsequent operation of the washer.

Where, therefore, water drain is carried out under an abnormal condition, water is retained in the water body during the first water-draining step. Where water drain proceeds under this condition, water is brought into the washer body also during the second water drain. If, therefore, the washer body has a small capacity, then water will overflow the washer body. Or even where the washer body has a large capacity, water overflows the washer all the same during the subsequent overflow rinsing step (a step of rinsing by supplying clear rinsing water with water drain undertaken at the same time).

It is accordingly an object of this invention to provide an automatic washer, wherein water and material of washing are received only in a rotary tub; water is mainly drawn off from the top of the rotary tub by a pumping action resulting from the rotation of the rotary tub with water fully filled therein; and which is characteristically designed to stop overflow by automatically stopping water drain, in case water drain is carried out at a low rate due to the omission of the downward throw of, for example, a water-draining hose.

This object is attained by providing an automatic washer which comprises a water-receiving body provided with a water-draining passage; a rotary tub built in the body and fitted with a stirring member concurrently to effect washing and dehydration; drive means for selectively driving the stirring member or rotary tub; a water guide passage provided with a valve in an intermediate position, extended between the bottom wall of the rotary tub and water-draining passage and so designed as to allow water to run at a larger flow rate on that side of the water guide passage valve which faces the water-draining passage than on that side of said valve which faces the rotary tub; detection means set on that side of the water guide passage valve which faces the rotary tub and designed to send forth a washer operation signal according to the extent to which the water level in the rotary tub falls; and control means which is connected to the drive means and the water guide passage valve, when set in a first position, closes the water guide passage valve, issues a signal instructing the rotation of the stirring member, and, when taking a second position, sends forth a signal instructing the opening of the water guide passage valve, and rotates the rotary tub in accordance with the contents of the washer operation signal.

This invention can be more fully understood from the following detailed description when taken in conjunction with the accompanying drawings, in which.

Figure 1:
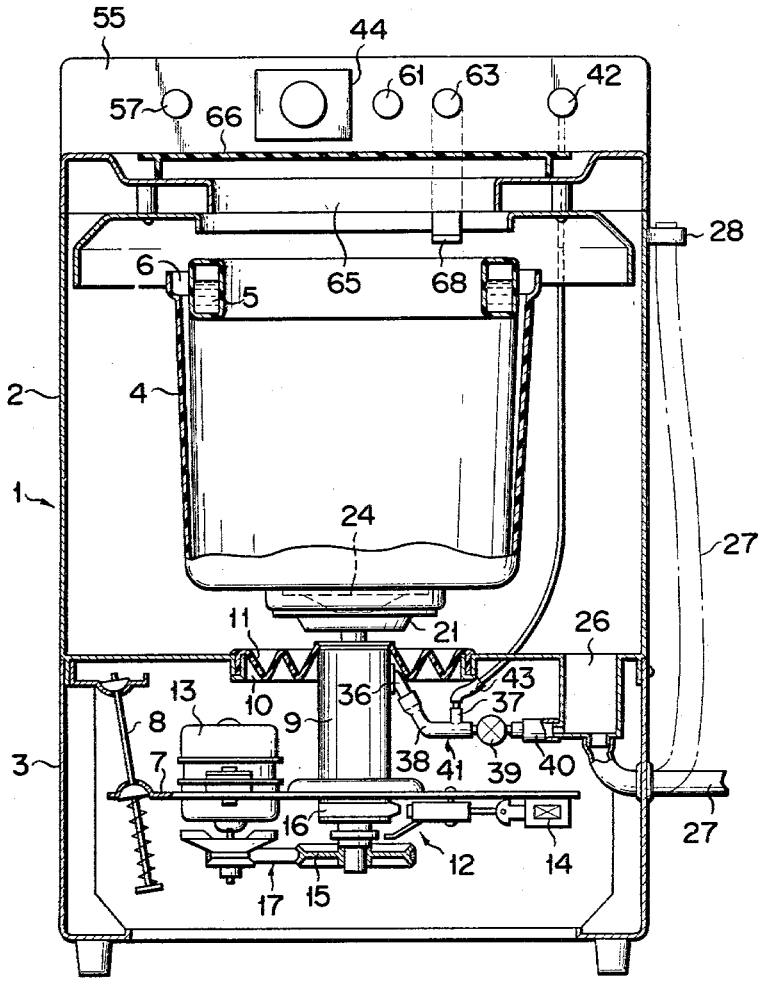
FIG. 1 is a partial longitudinal sectional view of an automatic washer embodying this invention.

There will now be described by reference to the accompanying drawings an automatic washer embodying this invention. Referring to FIG. 1, a washer body 1 consists of a water-receiving upper box section 2 mounted on a lower box section 3 used as a machine room. A rotary tub 4 concurrently used for washing and dehydration is received in the upper box section 2. The peripheral wall of the rotary tub 4 is not provided with dehydration ports, but is progressively more opened toward the top. During water drain and dehydration, the rotary tub is rotated and water received therein is discharged into the upper box section 2 by a pumping action resulting from the centrifugal force of the turning rotary tub 4 through a water-draining gap 6 formed between the upper portion of the rotary tub 4 and a balance ring 5. The balance ring 5 prevents material of washing from being thrown out of the rotary tub 4 during its rotation and also suppresses the eccentric shifting of tub 4 during its rotation. A support board 7 on which the later described drive system is mounted is elastically suspended by a suspending rod 8 in the lower box section 3. A bearing housing 9 concurrently used as the later described water guide chamber is fixedly mounted on the support board 7. The upper portion of the housing 9 is sealed in liquid tightness by means of bellows 11 in an opening 10 formed in the upper box section 2. A drive transmission control mechanism 12 and a washer motor 13 are securely set on the support board 7. The drive transmission control mechanism 12 is of the known type comprising an electromagnetic solenoid 14, clutch mechanism 15 controlled by said solenoid 14 and brake mechanism 16. The clutch mechanism 15 transmits a rotation moment delivered from the washer motor 13 through a belt transmission mechanism 17 selectively to a hollow dehydration shaft 18 or washing shaft 19 (shown in FIG. 2) received in the housing 9. The brake mechanism 16 normally applies a braking force to the dehydration shaft 18 and releases said braking force when dehydration actually takes place.

Figure 2:
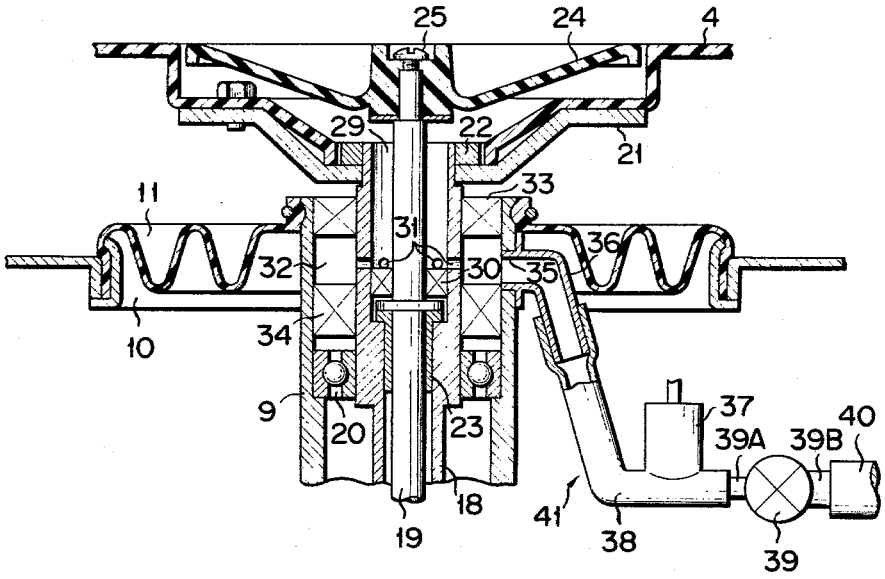
FIG. 2 is an enlarged longitudinal sectional view of the main section of said automatic washer.

There will now be described by reference to FIG. 2 the main section of an automatic washer embodying this invention. This dehydration shaft 18 rotatably penetrates the housing 9 by means of a bearing 20. The upper end of the dehydration shaft 18 is fixed to the underside of the bottom wall of the rotary tub 4 by means of a carrier 21 and tightening nut 22. The washing shaft 19 rotatably penetrates the hollow dehydration shaft 18 in the longitudinal direction by means of a bearing 23. A stirring blade member 24 is securely fixed to the upper end of the washing shaft 19 by means of a screw 25. A water-draining recess 26 (FIG. 1) is formed in the bottom wall of the upper box section 2. Connected to said recess 26 is one end portion of a water-draining hose 27, the other end portion of which penetrates the side wall of the lower box section 3 and is extended outside of the washer body 1. The water-draining recess 26 and water-draining hose 27 jointly constitute a water-draining passage. When the washer is not used, the water-draining hose 27 is set upright by means of a catch member 28 provided on the outside of the washer body 1 as, indicated in dot-dash lines. The upper portion of the dehydration shaft 18 has a larger diameter than the lower portion thereof, and a water guide 29 is formed, as shown in FIG. 2, between the inner wall of the larger diameter section of the dehydration shaft 18 and the outer wall of the inserted washing shaft 19. Water received in the rotary tub 4 is conducted to the water guide 29. The lower portion of the water guide 29 ends with a seal 30 inserted between the inner wall of the larger diameter section of the hollow dehydration shaft 18 and the outer wall of the inserted washing shaft 19. A water guide port 31 is formed in the peripheral wall of the larger diameter section of the dehydration shaft 18. Water passes through the water guide port 31 into a water guide chamber 32 defined by upper and lower spatially arranged seals 33, 34 inserted in liquid tightness between the housing 9 and the dehydration shaft 18. Connected to an outlet port 35 of said water guide chamber 32 is one end of a pipe joint 36, the other end of which is connected to one end of a connector pipe 38. The other end of the connector pipe 38 is provided with an air trap and connected to one end of a flexible connector hose 40 through an electrically driven valve 39.

A route extending from the upper end of the water guide 29 to the water-draining recess 26 constituting a water-draining passage through the water guide port 31, water guide chamber 32, pipe joint 36, connector pipe 38, electrically driven valve 39 and connector hose 40 jointly form a water guide passage 41. The washer of this invention is designed such that a maximum flow rate Q2 of water running out of that opening 39B of the valve 39 which faces the connector hose 40 is made higher than a maximum flow rate Q1 of water flowing into that opening 39A of the valve 39 which faces the connector pipe 38 to meet the required relationship of $Q2>Q1$, the total cross sectional area of the water guide port 31 is made substantailly equal to that of the opening 39A of the valve 39, and the ratio between the cross sectional area (154 $cm^2$) of the opening 39B of the valve 39 and the cross sectional area (105 $cm^2$) of the opening 39A of the valve 39 is chosen to be about 7:5. Where, therefore, the electrically driven valve 39 is opened, and water runs from the rotary tub 4 to the water-draining hose 27, then air pressure in the air trap 37 never fails to drop. That section of the water guide passage 41 which is formed of the connector pipe 38 provided with an air trap, electromagnetic valve 39 and connector hose 40 is made to take a substantially horizontal position when the rotary tub 4 is filled with washing and rinsing water to a prescribed level and brought downward. The air trap 37 is connected through a tube 43 (FIG. 1) to a pressure-actuated water level switch 42 of the known arrangement. The water level switch 42 is operated in accordance with the magnitude of air pressure prevailing in the air trap 37 which varies with the water level in the rotary tub 4. Where the rotary tub 4 is filled with water to a prescribed level, then the water level switch 42 is brought to a set position. Where the water level indicates any drop from the prescribed point, then the water level switch 42 is reset.

Figure 3:
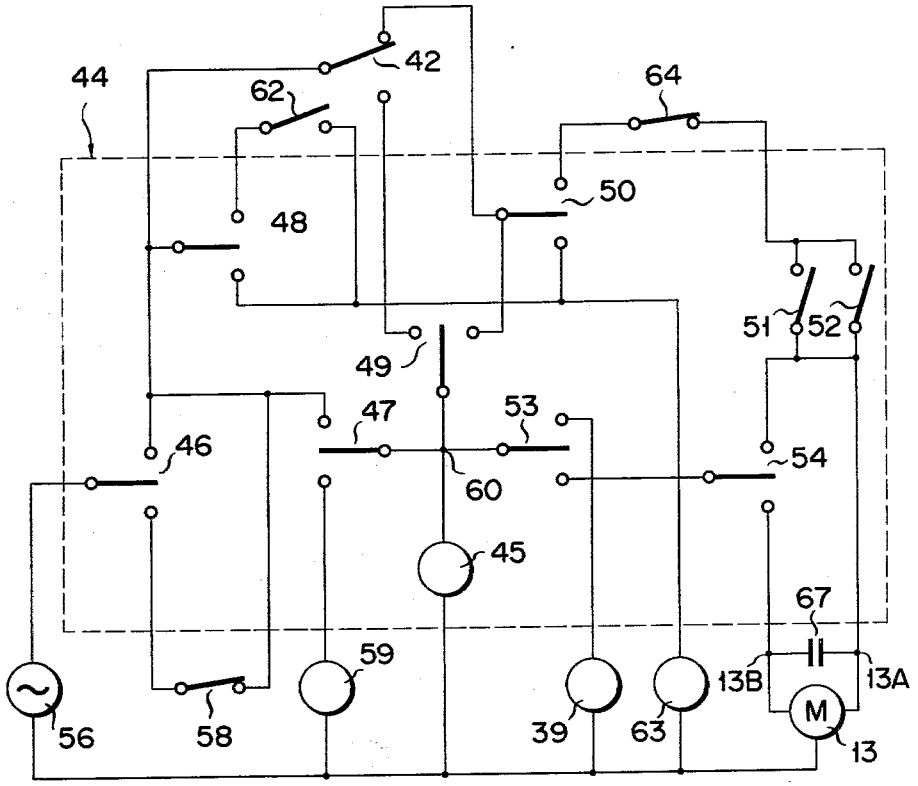
FIG. 3 shows the arrangement of a control circuit for ensuring the automatic operation of said washer.

There will now be described by reference to FIG. 3 the arrangement of a control circuit effecting the automatic operation of the washer of this invention. A timer 44 enclosed in broken lines is formed of a timer motor 45 and cam switches 46 to 54. The timer 44 is received in a control box 55 mounted on the washer body 1 of FIG. 1. The movable contact of the cam switch 46 is connected to a single phase AC source 56. The first contact of said cam switch 46 is connected to the first contact of a cam switch 47. The second contact of the cam switch 46 is also connected to the first contact of the cam switch 47 through a water drain stop-selecting switch 58 operated by a water drain stop button 57 mounted on the control box 55. The first contact of the cam switch 46 is also connected to the movable contact of the cam switch 48 and water level switch 42. The second contact of the cam switch 47 is connected to the A.C. source 56 through a buzzer 59. The movable contact of the cam switch 47 is connected to the A.C. source 56 through a junction 60 and timer motor 45.

The first and second contacts of the cam switch 48 are connected together by an overflow rinsing selecting switch 62 operated by an overflow button 61 mounted on the control box 55. The first and second contacts of the cam switch 48 are connected to the A.C. source 56 through an electrically opperated water supply valve 63.

The first contact (set contact) of the water level switch 42 is connected to the first contact of a cam switch 49. The second contact (reset contact) of said water level switch 42 is connected to a movable contact of a cam switch 50 and also to the second contact of the cam switch 49. The movable contact of the cam switch 49 is connected to the A.C. source 56 through the junction 60 and timer motor 45. The first contact of the cam switch 50 is connected to one end of the parallel-connected cam switches 51, 52 respectively through a cap switch 64. The second contact of the cam switch 50 is connected to the A.C. source 56 through the water supply valve 63. A cap switch 64 is operated interlocking with a washer cap 66 which is operatively mounted on an opening 65 through which material of washing is inserted into a washer or taken out therefrom. When the cap 66 in closed, the cap switch 64 is closed.

The junction 60 is connected to a movable contact of a cam switch 53, whose first contact is connected to the A.C. source 56 through the valve 39, and whose second contact is connected to the movable contact of a cam switch 54. The first contact of the cam switch 54 is connected to the other end of the parallel-connected cam switches 51, 52 respectively, and also to the normal rotation terminal 13A of the washer motor 13. The second contact of the cam switch 54 is connected to the reverse rotation terminal 13B of said washer motor 13. A capacitor 67 for the drive of the washer motor 13 is disposed between the normal and reverse rotation terminals 13A, 13B and connected to the A.C. source 56.

Figures 4A, 4B, 4C, 4D, 4E, 4F, 4G, 4H, 4I, 4J:
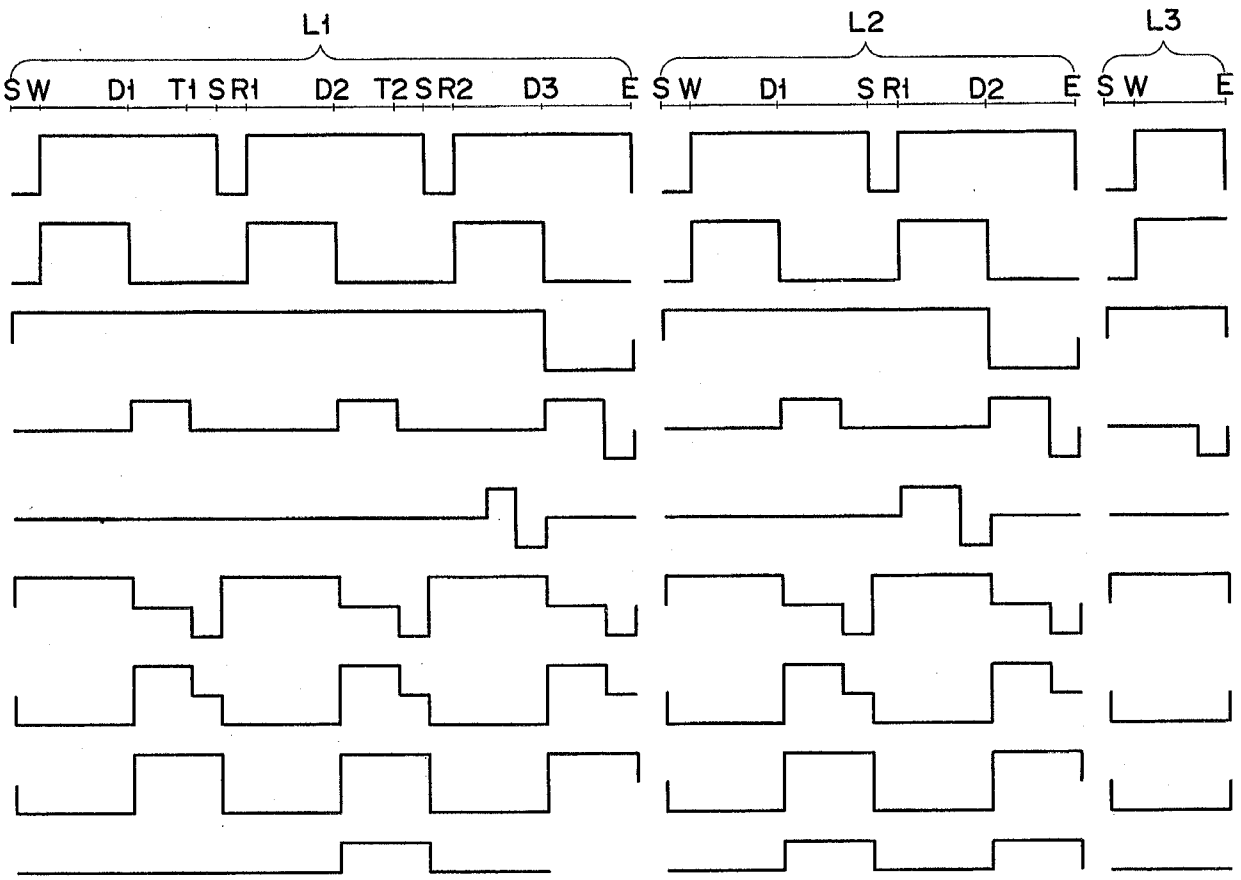
FIGS. 4A to 4J illustrate the operation of the control circuit of FIG. 3.

There will now be described the operating of the control circuit by reference to FIGS. 4A to 4J. FIG. 4A indicates the periods of the respective steps of washing. S denotes water supply; W washing; D1 to D3 first to third water drain steps (the third water drain includes dehydration); R1, R2 rinsing; E completion of washing; L1 standard washing course; L2 shortened washing course; and L3 exclusive washing course. Referring to the L1 course, W takes 10 min.; D1 2 min.; R1 2 min. 10 sec.; D2 2 min.; R2 3 min. 15 sec.; and D3 5 min. Referring to the L2 course, W consumes 5 min.; D1 3 min.; R1 2 min. 50 sec.; and D2 2 min. 50 sec. Referring to the L3 course, W takes 6 min. 55 sec. FIG. 4B indicates the manner in which the timer motor 45 is intermittently operated. A high level denotes the period in which the timer motor 45 is driven; and a low level shows the period in which the timer motor 45 stands at rest. FIG. 4C shows the condition in which the water level switch 42 is closed. A high level indicates the set position of said switch 42 in which the movable contact touches the first contact. A low level represents the reset position of said switch 42 in which the movable contact touches the second contact. FIGS. 4D to 4I set forth the condition in which the cam switches 46 to 50, and 53 are closed. A high level shown the first condition in which the movable contact touches the first contact. A low level represents the second condition in which the movable contact touches the second contact. A zero level denotes the condition in which the movable contact touches neither first nor second contact, that is, a neutral state. FIG. 4J illustrates the manner in which the cam switch 51 is opened and closed. A high level sets forth the operation of said switch 51, and a low level indicates its inoperative state.

Though not illustrated, the cam switch 52 is repeatedly rendered nonconducting for 22 seconds and rendered conducting for 8 seconds. This cycle is sustained while the timer motor 45 is driven. During the rotation of the timer motor 45, the cam switch 54 is repeatedly closed for about 26 seconds alternately to be set at the first and second positions with a neutral position of about 4 seconds intervened therebetween. The normal rotation terminal 13A and reverse rotation terminal 13B of the washer motor 13 are alternately supplied with power. In other words, the washer motor 13 regularly makes normal and reverse rotations.

There will now be described the operation of the washer of this invention during the standard washing course L1. Reference is first made to the common case where the water-draining hose 27 is thrown downward, and water is drained without any obstruction in the water-draining passage. First, the respective cam switches 46 to 54 are set in a position specified for the water supply step S. Since, at this time, no water is taken into the rotary tub 4, the water level switch 42 remains in a reset position. Current is supplied from the AC source 56 to the water supply valve 63 through the cam switch 46 hold in a first position, water level switch 42 remaining in a reset position and the cam switch 50 taking a second position. As a result, the water supply valve 63 is opened to introduce water into the rotary tub 4 through a water supply port 68 (FIG. 1). Since, at this time, the cam switch 53 is held in a second position, the water-draining valve 39 is not supplied with power, and consequently remains closed. Water brought into the rotary tub 4 is conducted into the air trap 37 through the water guide passage 29 formed at the bottom of the rotary tub 4, water guide port 31, water guide chamber 32, pipe joint 36 and connector pipe 38. The water compresses air in the air trap 37 by pushing it upward. Water filled in the rotary tub 4 reaches a required level for washing, then the water level switch 42 is shifted to a set position. Now, current is supplied from the AC source 56 to the junction 60 through the cam switch 46 set in the first position, water level switch 42 held in the set position, and cam switch 49 taking the first position. As a result, the timer motor 45 begins to be rotated for a time-counting operation. Current is alternately supplied to the normal rotation terminal 13A and reverse rotation terminal 13B of the washer motor 13 through the junction 60, cam switch 53 set in a second position and cam switch 54 whose closed position is alternately changed. Thus the washer motor 13 is driven with the direction of its rotation alternately shifted. At this time, the stirring blade member 24 is rotated to commence the washing step W.

After a prescribed length of time, the cam switches 46 to 54 are set in a closed position ready for the step D1 of FIG. 4. Current continues to be supplied to the junction 60 through the cam switches 46, 47 both held in the first position, and the timer motor 45 also continues to be driven. Since, at this time, the cam switch 53 is shifted to the first position, the valve 39 is supplied with power through the junction 60. As a result, the valve 39 is opened to cause water held in the rotary tub 4 to be drawn off to the outside through the water-draining recess 26 and water-draining hose 27. Along the water guide passage 41, the section of the opening 39B of the valve 39 which faces the connector hose 40 is previously designed to allow for a higher maximum flow rate of water than the section of the opening 39A of the valve 39 which faces the connector pipe 38. When, therefore, the valve 39 is opened, air pressure in the air trap 37 decreases rapidly (substantially in less than one second) to a level lower than that which corresponds to the level when the water level switch 42 is set. As a result, switch 42 is reset. When the water level switch 42 is reset, the rotary tub 4 begins to be driven in one direction. In other words, the washer motor 13 is supplied with power through said water level switch 42 now reset, cam switch 50 held in the first position, cam switch 64, cam switch 52 and the normal rotation terminal 13A of said washer motor 13. In this case, however, the cam switch 51 remains nonconducting, the cam switch 52 is intermittently operated at the aforesaid time interval, and the washer motor 13 is intermittently supplied with power. Therefore, the rotary tub 4 is rotated at a lower speed than during the washing step W in which the rotary tub 4 is continuously supplied with power. Part of the water held in the rotary tub 4 is directly conducted out of the washer through the water guide passage 41. The remainder of the water is drawn into the upper box section 2 through dehydration gap 6 due to a pumping action resulting from the centrifugal force of the turning rotary tub 4, and then expelled out of the washer through the water-draining recess 26 and water-draining hose 27.

At time T1 in FIG. 4A, the closed condition of the cam switches 47, 49, 50 is changed by the timer motor 45, as shown in FIGS. 4E, 4G and 4H respectively. The timer motor 45 and valve 39 continue to be supplied with power through the cam switch 49 held in the second position, and consequently the water-draining step is carried on. Since, at this time, the cam switch 50 takes a neutral position, the washer motor 13 ceases to be supplied with power.

The first water-draining step D1 is followed by the water supply step S. Where water is supplied to the rotary tub 4 to a prescribed level after the timer motor 45 is temporarily stopped, then the first rinsing step R1 ensues. The water level switch 42 is set and the timer motor 45 is rotated again to commence rinsing by clear water. The rinsing step R1 is so controlled as to end in a shorter time then the washer step W. The subsequent various operation steps of the washer are successively shifted as 2nd water drain D2→2nd rising R2→3rd water drain D3 (including dehydration). At the 2nd and 3rd water drain steps D2, D3; the cam switch 51 is closed and, the washer motor 13 is supplied with power causing the rotary tub 4 to be rotated at a higher speed than at the first water drain step D1. The cam switch 47 is brought to the second position near the end of the third water drain (including dehydration) step D3, and a buzzer 59 blows. At this time, current flowing from a power source 56 is supplied to the timer motor 45 through the cam switch 49 shifted to the second position. In the latter half of the second rinsing step R2, the cam switch 48 takes the second position, causing the water supply valve 63 to be supplied with power independently of the position of the water level switch 42. Since, at this time, the valve 39 remains closed, water continues to run into the rotary tub 4. At the same time, water through into the rotary tub 4 overflows into the upper box section 2 through the dehydration gap, that is to say overflow rinsing step is proceeded. Where an overflow rinsing step-selecting switch 62 is previously closed by the overflow button 61, the overflow rinsing step can be commenced when the cam switch 48 is shifted to the first position during the second rinsing step R2.

Where the water used in the second rinsing step R2 is not much soiled, the water in the rotary tub 4 can be used again in the succeeding washing course if operation does not proceed to the third water drain step D3. This is accomplished by suspending washing at the second rinsing step R2. Where a water drain stop-selecting switch 58 is left open by operation of a water drain stop button 57, then the cam switch 46 is shifted to the second position upon completion of the second rinsing step R2. At this time, the junction 60 is electrically cut off from the power source 56. Thus, the water in the rotary tub 4 can be utilized again in the following washing course.

The foregoing description refers to the standard washing course L1. However, the shortened washing course L2 and exclusive washing course L3 can be carried out in accordance with the timing chart of FIG. 4.

There will now be described with respect to the standard washing course L1 the operation of the automatic washer of this invention to prevent abnormal overflows of water resulting from washing carried out under the condition where the normal water drain is not effected, for example, the operator forgets the downward throw of the water-draining hose 27, or foreign matter plugs the water-draining passage with a decline in the water-draining function. In this connection, let the following conditions be assumed. When the standard washing course L1 proceeds to the first water-draining step D1 after completion of washing W, then the electromagnetic valve 39 is opened. Water traveling from the rotary tub 4 to the opening 39A of the electromagnetic valve 39 included in the water guide passage 41 runs out into the water-draining recess 26 through the connector hose 40. Where the water-draining hose 27 is still left in an upright position, as indicated in dot-dash lines, due to the carelessness of an operator instead of being thrown down as it should be to effect a proper washing step, water in the rotary tub 4 is taken into the upper box section 2 and the upright-positioned water-draining hose 27 to the same level. The water level switch 42 is shifted to a reset position. At this time, the normal rotation terminal 13A of the washer motor 13 is rendered conducting, causing the rotary tub 4 to be turned for water drain under a fully filled condition. Since, however, the water-draining hose 27 is not thrown downward, water is not drawn off from the upper box section 2, but remains therein. Where the operation proceeds from the first water drain step D1 to the first rinsing step R1 by the operation of the timer motor 45, said first rinsing step R1 is carried out in the same manner as in the normal condition, though the upper box section 2 is still filled with water.

Where the operation proceeds to the second water drain step D2, then the valve 39 is opened. At this time, water is fully filled not only in the upper box section 2, but also in the water guide passage 41 including the water-draining recess 26, valve 39 and connector hose 40. Even where, therefore, the valve 39 is opened, the aforesaid requisite condition of $Q2>Q1$ is not brought about, where the flow rate Q2 of water conducted from the valve 39 to the water-draining hose 27 is chosen to be larger than the flow rate Q1 of water running from the rotary tub 4 to said valve 39 under normal conditions. Consequently, air pressure in the air trap 37 does not fall substantially, and the water level switch 42 retains the set position specified for the first rinsing step R1. Therefore power supply to the washer motor 13 is not carried out, which is conditioned on the resetting of the water level switch 42. Accordingly, the rotary tub 4 remains fully filled with water. At time T2, the cam switch 47 is shifted to a central position, the cam switch 49 is shifted to the second position, and the water level switch 42 is in a set position. At this time, the timer motor 45 is immediately cut off from a power source, and the operation of the washer ceases to proceed. Where, therefore, the upper box section 2 is still filled with water which is drained off during the first water drain step D1, the water in the rotary tub 4 is not discharged into the upper box section 2 during the second water drain step D2. Consequently, it is possible to suppress the abnormal excess load operation of the washer in which the rotary tub 4 is rotated with the upper box section 2 fully filled with water. As previously mentioned, the dehydration of the rotary tub 4 is commenced after the completion of the washing step W, when the water level switch 42 is reset due to the opening of the valve 39. Therefore, some time interval arises between the completion of the washing step W and the commencement of the rotation of the rotary tub 4. Even where the rotary tub 4 begins to be rotated in a direction opposite to that in which washing water runs, the vertical flow of water streams vanishes during the above-mentioned time interval, thereby allowing for the easy start of the rotary tub 4.

What is claimed is:

1. An automatic washer for automatically washing materials to be cleaned comprising:

a washer body;

a stirring member;

a rotary tub for holding water and said materials to be cleaned, received in said washer body and fitted with said stirring member;

a water-draining conduit defining a first water passage and a water guide conduit defining a second water passage, for directing said water from said rotary tub to an exterior location;

said water guide conduit extending between said water-draining conduit and the bottom of said rotary tub and including a valve in a position intermediate of said water-draining conduit and said rotary tub bottom, the portion of said water guide conduit downstream of said valve having a minimum cross-sectional area which is larger than the minimum cross-sectional area of the portion of said water guide conduit upstream of said valve, so that the drainage fluid flow capacity of said water guide conduit downstream of said valve exceeds the fluid flow capacity upstream of said valve;

drive means for selectively rotating said stirring member for washing said materials or rotating said rotary tub to remove water from, and thereby dehydrate, said materials to be cleaned;

means, bypassing said water guide conduit, for delivering water removed from said materials to be cleaned and a portion of said water in said tub to said water-draining conduit;

detection means, disposed at said water guide conduit upstream of said valve, for detecting a fall in the level of said water in said tub and for issuing an operation signal upon detection of said fall in said water level; and control means, responsive to said operation signal, alternatively disposed in a first and a second position and coupled to said drive means and said valve, for closing said valve and rotating said stirring member when said control means is set in said first position and for opening said valve to drain said tub when said control means takes said second position and then rotating said rotary tub in response to said operation signal while said control means is disposed in said second position and said water is draining from said tub so as to simultaneously drain said water from said tub and dehydrate said materials to be cleaned.

2. The automatic washer according to claim 1, wherein said control means comprises means for preventing said drive means from rotating said stirring member or said rotary tub and for preventing automatic washing by said washer from otherwise proceeding until said detection means issues said operation signal when said control means is set in said second position.

3. The automatic washer according to claim 1 or claim 2, wherein the detection means is provided with an air trap; and the control means comprises a timer motor and cam switches whose contacts are closed under the control of a timer motor and a pressure-actuated switch connected to the air trap.

4. The automatic washer according to claim 1 wherein said detection means comprises means for detecting a fall in water pressure upstream of said valve.

* * * * *